US007207536B2

(12) United States Patent
Conway et al.

(10) Patent No.: US 7,207,536 B2
(45) Date of Patent: Apr. 24, 2007

(54) BIAS-ASSISTED SIGN WITH FLOATING MOUNT SYSTEM

(75) Inventors: Thomas M. Conway, Park Ridge, IL (US); Scott Padiak, Skokie, IL (US); Paul C. Evans, Chicago, IL (US)

(73) Assignee: Cormark, Inc., Des Plaines, IL (US)

( * ) Notice: Subject to any disclaimer, the term of this patent is extended or adjusted under 35 U.S.C. 154(b) by 256 days.

(21) Appl. No.: 10/826,767

(22) Filed: Apr. 16, 2004

(65) Prior Publication Data

US 2005/0040305 A1 Feb. 24, 2005

Related U.S. Application Data

(60) Provisional application No. 60/495,371, filed on Aug. 18, 2003.

(51) Int. Cl.
*A47G 29/02* (2006.01)
*E04G 3/08* (2006.01)
*E06B 7/28* (2006.01)

(52) U.S. Cl. ..... 248/250; 248/218.4; 248/219.1; 40/606.1

(58) Field of Classification Search ..... 248/219.1, 248/218.4, 221.12, 220.31, 220.22, 250, 248/289.11, 276.1, 220.21; 40/606.1, 642.02; 16/317

See application file for complete search history.

(56) References Cited

U.S. PATENT DOCUMENTS 2,787,433 A * 4/1957 Slavsky et al. ..... 248/231.71
3,637,178 A * 1/1972 Golden ..... 248/145
5,803,420 A 9/1998 Conway et al.
5,934,633 A 8/1999 Padiak et al.
6,086,033 A * 7/2000 Calleja ..... 248/240
6,484,988 B2 11/2002 Conway et al.
6,691,963 B1 * 2/2004 Padiak et al. ..... 248/220.22
2004/0195483 A1 * 10/2004 Padiak et al. ..... 248/289.11

* cited by examiner

*Primary Examiner*—Amy J. Sterling
(74) *Attorney, Agent, or Firm*—Welsh & Katz, Ltd.

(57) ABSTRACT

A biased-assisted sign mounting system is for mounting a sign to a structure, that includes a vertical upright post having a face having a plurality of vertically extending, spaced apart openings. The mounting system includes a spine adapted to mount to the vertical post. The spine has a face portion. Upper and lower sign mount portions are mounted to the spine. At least one of the mount portions has a biasing element securing portion. Upper and lower arms are mounted to respective upper and lower sign mount portions. The arms each have a pivot defining collinear axes. One of the upper and lower arms has a biasing element securing portion. A biasing element operably connects one of the arms to its respective mount portion such that the arm is pivotal between first and second positions and is biased toward the first and second positions by the biasing element. A floating insert mounts the spine to the upright. The floating insert has a body portion for engaging the spine and the upright, and for spacing the spine face from the upright face. The floating insert has a latch portion disposed in the body that is engageable with the upright to secure the floating insert to the upright. The latch includes a fastener extending therefrom that is engageable with the spine to secure the spine to the floating insert. When the floating insert is engaged with the upright and the latch fastener is engaged with the spine, the spine is secured to the upright with the face portion of the spine spaced from the face of the upright.

19 Claims, 3 Drawing Sheets

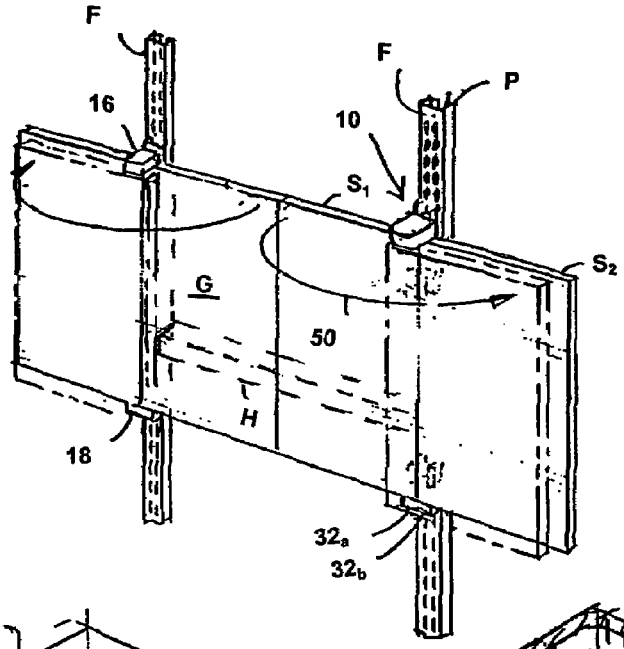
FIG. 1
FIG. 2
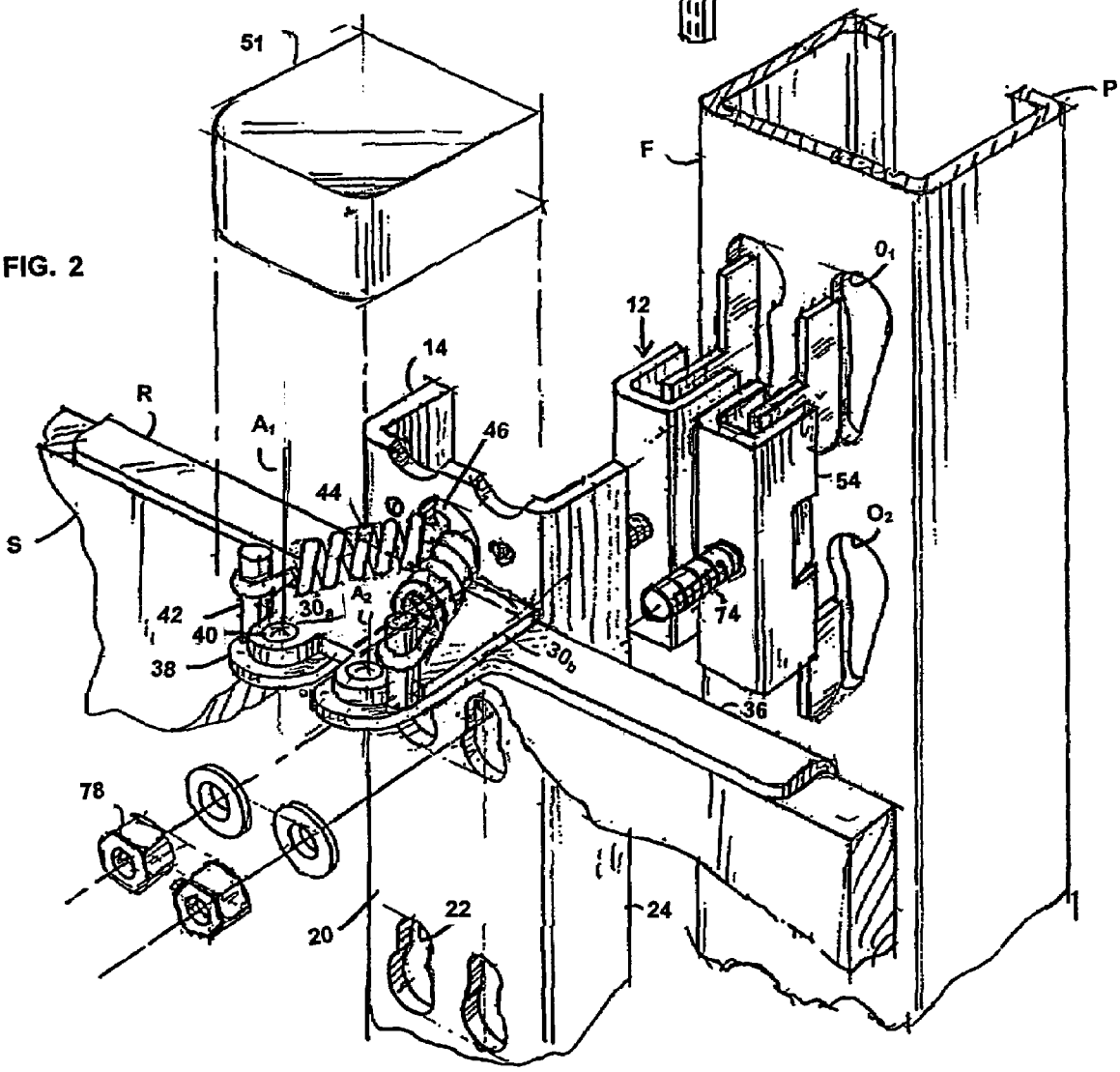

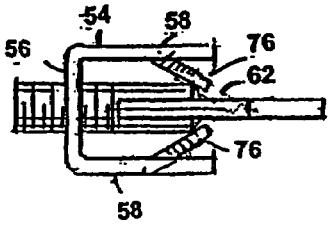
FIG. 3
FIG. 4
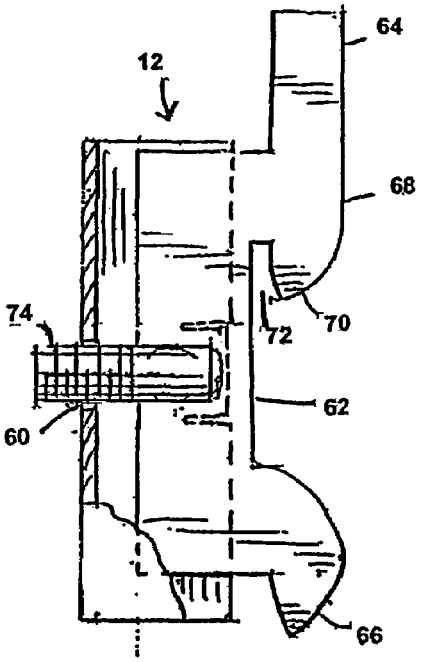
FIG. 5
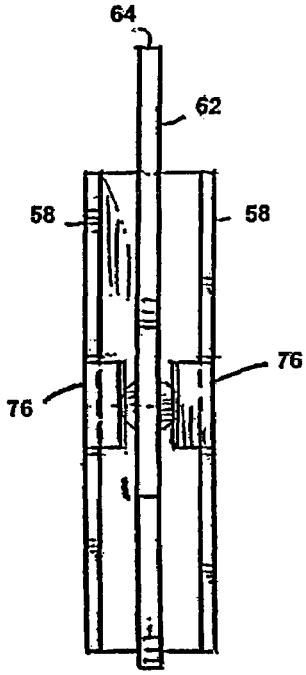
FIG. 6
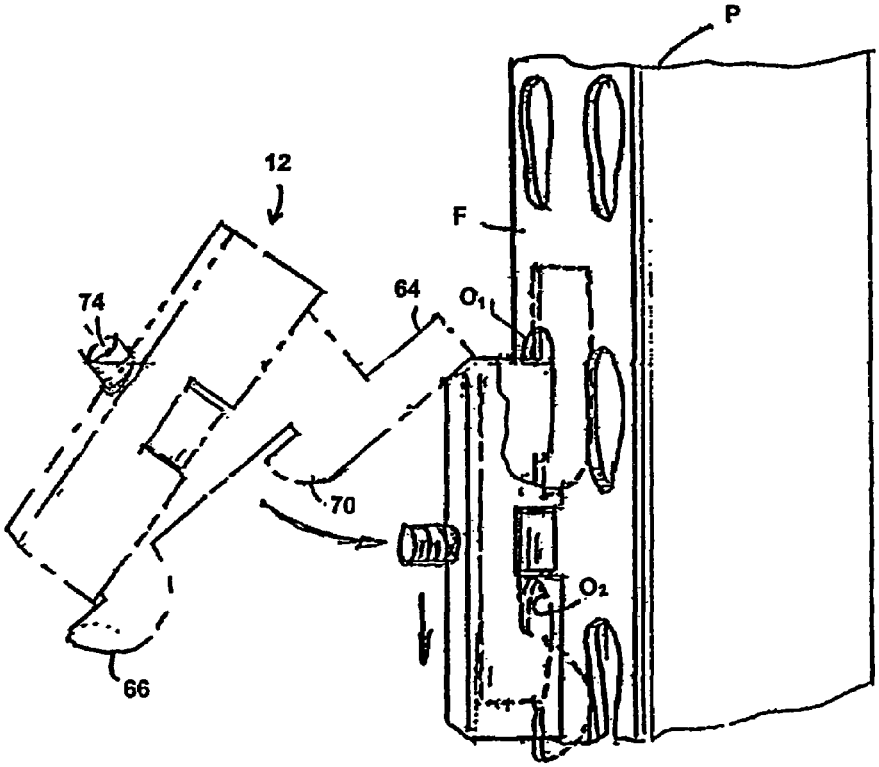

BIAS-ASSISTED SIGN WITH FLOATING MOUNT SYSTEM

The present application claims the benefit of the filing date of U.S. Provisional Application Serial No. 60/495,371, filed 18 Aug. 2003.

BACKGROUND OF THE INVENTION

The present invention is directed to a bias-assisted sign mounting system. More particularly, the present invention is directed to a pivotal, two-position sign mounting system that uses a bias-assist to maintain the sign in an open or closed position and a floating mount system for spacing the sign from the structure on which it is installed.

Signs, and more particularly, point-of-purchase sign or display systems can, when properly designed, be tremendously effective marketing tools. The systems have become widely popular in all manners of retail trade.

In one common use, signs are mounted to shelving systems that permit loading of pallets and palletized items onto the shelves. These are commonly referred to as pallet racks. These arrangements permit the storage of large items and large amounts of items on each of the shelves. However, the shelves do not typically lend themselves to the mounting of point-of-purchase displays or signs.

Many known signs are permanently or semi-permanently affixed to the shelves and are hung above or below the shelving systems. While these signs function well to direct a consumer's attention to the particular products, they do not permit ready access to the shelves to, for example, restock the shelves or retrieve items therefrom. This, of course, is particularly true of those signs that are permanently or semi-permanently affixed to the shelves.

Known mounting systems include those disclosed in Padiak et al, U.S. Pat. No. 5,934,633 entitled "Pivotal, Two-Position Locking Side Mounting System" and Conway et al., U.S. Pat. No. 5,803,420 entitled "Universal Side Mounting Device". Another known mounting system is disclosed in Conway et al., U.S. Pat. No. 6,484,988 entitled "Bias-Assisted Sign Mount". All of these patents are commonly assigned with the present application and are incorporated herein by reference.

All of these systems function well. In fact, they provide one or more mounting arrangements that are used to position a sign in a particular, desired orientation and position that is effective for point-of-purchase marketing. The systems in one or more forms permit fully rotating or pivoting the sign out of the way, from a display position to a storage position, to restock the shelves over or behind which the signs are located.

However, one drawback to these systems is the inability to aesthetically mount the signs over horizontal rack beams. It has been found that the horizontal beams, including the beams on which the shelves are positioned, can extend slightly outwardly from the vertical uprights or posts. Alternately, the horizontal beams overlie openings into which the sign mounts must be inserted. As such, the signs may not lie flush with the rack. This is an aesthetically undesirable situation.

Accordingly, there exists a need for a point-of-purchase display or sign mounting system that can position a sign in a particular, desired orientation and position. Such a system permits fully rotating or pivoting the sign out of the way for restocking the shelves and pivoting back to a display position. Most desirably, such a system permits mounting the sign in a manner such that it can overlie a horizontal beam that, for example, supports a shelf or the like.

BRIEF SUMMARY OF THE INVENTION

A biased-assisted sign mounting system is configured to mount a sign to a structure, such as a pallet rack, that includes a vertical upright post having a face with a plurality of vertically extending, spaced apart openings. The mounting system permits the use of a fully rotating or pivoting sign. In such an arrangement, the sign is pivoted out of the way to a storage position, for example for access behind the sign, and pivoted back to a display position. The mounting system permits such a mounting in a manner that allows the sign to overlie a horizontal beam that, for example, supports a shelf or the like.

The mounting system includes a spine adapted to mount to the vertical post. The spine has a front face. Upper and lower sign mounts are mounted to the spine. At least one, and preferably both, of the sign mounts have a biasing element securing portion. Upper and lower arms are mounted to respective upper and lower mounts. The upper and lower arms each have a pivot portion that defines a pivot axis. The pivot axes are collinear. One or both of the arms have a biasing element securing portion.

A biasing element such as a spring operably connects the upper and/or lower arm to its respective mount portion at the respective biasing element securing portion. The arm is pivotal between first and second (open and closed) positions and is biased toward the open and closed positions by the biasing element.

A floating insert mounts the spine to the upright. The floating insert has a body portion for engaging the spine and the upright, and for spacing the spine face from the upright face. The floating insert has a latch portion disposed in the body. The latch is engageable with the upright to secure the floating insert to the upright. The latch includes a fastener, such as a threaded stub, extending therefrom that is engageable with the spine to secure the spine to the floating insert. When the insert is engaged with the post and the latch fastener is engaged with the spine, the spine is secured to the upright with the face portion of the spine spaced from the face of the upright. Tightening the fastener tensions or locks that latch to the post.

A present insert body includes a central support portion and depending legs extending from the central support portion. The central support portion is adapted to engage the spine and the legs are adapted to engage the face of the upright to space the face of the spine from the face of the upright. Tabs can be formed in the legs, urged inwardly toward one another, to retain the latch within the body.

A present latch has a finger and a first hook element spaced from one another. The finger and first hook element are opposingly oriented. A base portion of the finger can include a second hook that is commonly oriented with the first hook element. In this manner, the second hook is disposed between the finger and the first hook element. The second hook can be formed as a slot in the base portion of the finger.

In the present latch, the fastener is a threaded stub and the insert body includes an opening for receiving the threaded stub. The stub is adapted for insertion into an opening in the spine face portion.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein:

FIG. 1 is a perspective view of a bias-assisted sign mounting system illustrating a pair of signs mounted to adjacent vertical uprights and overlying a horizontal beam extending between the vertical uprights, the signs being mounted with a floating mount in accordance with the principles of the present invention;

FIG. 2 is an enlarged, exploded view of the mount;

FIG. 3 is a top view of the floating insert;

FIG. 4 is a side view of the insert shown partially broken away;

FIG. 5 is a rear view of the insert;

FIG. 6 is a perspective view of the insert as it is inserted into the vertical upright and locked in the upright.

DETAILED DESCRIPTION OF THE INVENTION

Figure 7:
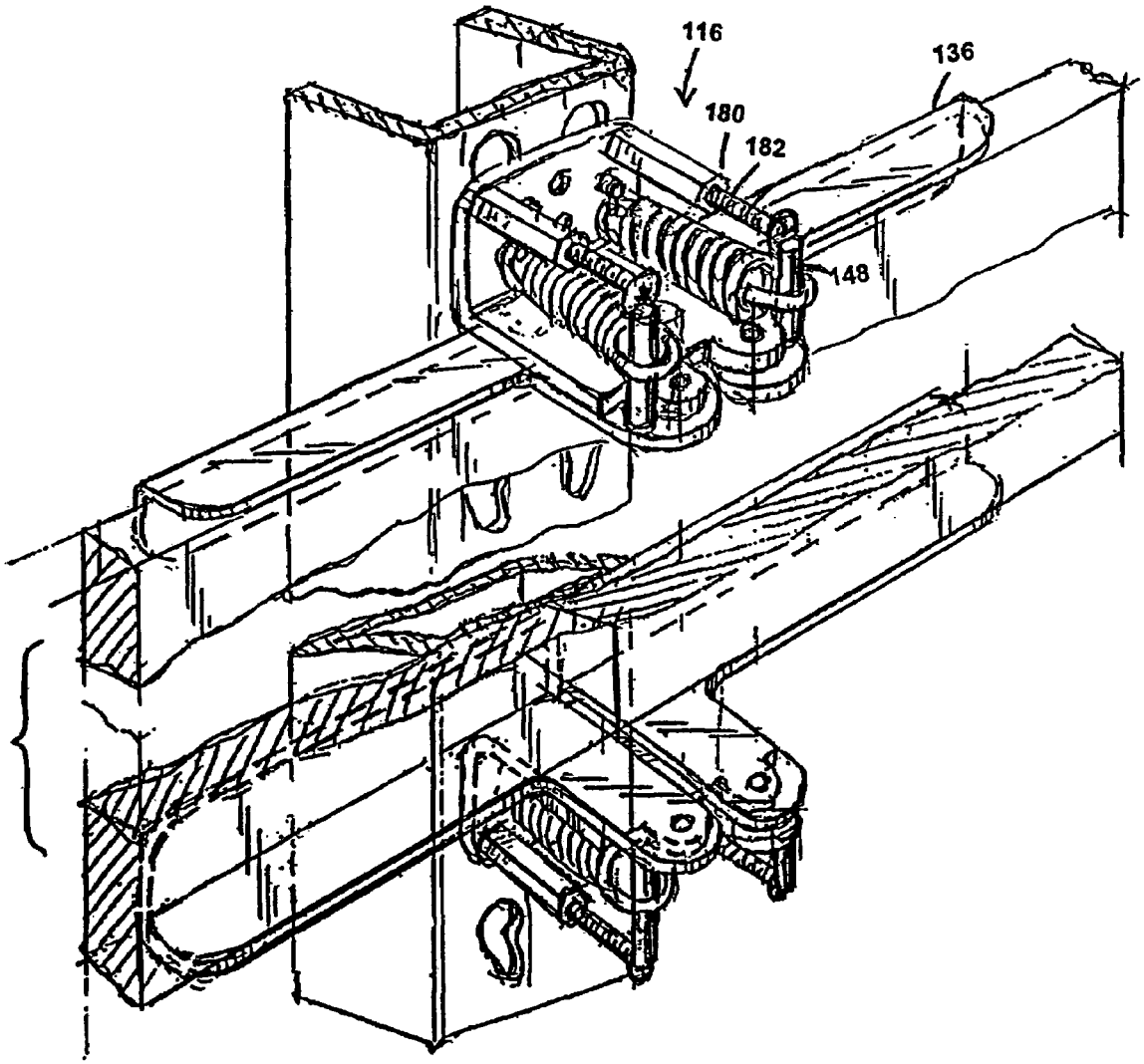
FIG. 7 is a perspective view of an alternate embodiment of the bias-assisted sign mount.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIGS. 1 and 2, there is shown an embodiment of a bias-assisted sign mount 10 having a floating mount 12 embodying the principles of the present invention. The present sign mounting system 10 provides a pivotal, two-position sign mounting system that uses a bias-assist to maintain the sign S in an open or closed position, and a floating mount 12 that permits mounting the sign S onto, but spaced from the front face of a vertical upright or post P. This arrangement permits mounting the sign S over (overlying) a horizontal beam H that extends between uprights P. Such a horizontal beam H can be used to, for example, support a shelf or simply provide additional structural support for the rack.

The particulars of operation and function of the bias-assisted mounting arrangement are similar to those disclosed in the aforementioned Conway, et al. U.S. Pat. No. 6,484,988.

The mounting system 10 includes a spine 14 having an upper sign mount 16 and a lower sign mount 18 affixed or mounted thereto. The spine 14, as will be described below, and which can resemble the front portion of the upright P (e.g., having a face 20 with openings 22 and depending legs 24), is mounted to the upright P by the floating mount or insert 12. The upper and lower mounts 16, 18 include plates (upper 26 only shown) each defining a pivot 30, 32. In a present embodiment, the plates 26 are configured to support side-by-side signs $S_1$, $S_2$ and as such, have side-by-side pivot locations 30*a,b* and 32*a,b*. The respective upper and lower pivots 30*a,b* and 32*a,b* are aligned with one another to define vertical axes $A_1$, $A_2$ of rotation of the signs $S_1$, $S_2$. The pivots 30*a,b* and 32*a,b* are formed forward of the mount/spine juncture, indicated at 34 in FIG. 2.

The signs $S_1$, $S_2$ are each configured having an arm 36 that includes a pivot section 38 at an end thereof. Each arm 36 is mounted at its pivot section 38 to a respective mount pivot 30*a,b*, 32*a,b*, by a pivot pin 40. In the illustrated embodiment, the pivot section 38 extends from the arm 36, transverse to the sign S graphic G plane. The arm 36 further includes an arm spring or biasing element securing portion 42 that is spaced or offset from the pivot 30*a,b*, 32*a,b*. The arm 36 also serves as a stop. A spring 44 is mounted to the mount 16, 18 and to the arm 36. In this configuration, when in the display and storage positions, the spring 44 is in tension, but it is in a lesser tensioned state, relative to positions between the display and storage positions. That is, as the sign S is rotated from the display position to the storage position, the spring 44 is pulled or further tensioned through that rotation. As such, the lesser tensioned states are those that occur when the sign S is in the display or storage positions. Because these are the lesser tensioned states, the sign S will tend toward and remain in these positions by the spring 44 tension.

Those skilled in the art will appreciate that the most tensioned state is that point at which the spring 44 is at a maximum stretch. In the present mount system 10 this point is reached when the mount spring or biasing element securing portion 46 and the arm spring securing portion 42 are aligned with their pivots 30*a,b*, 32*a,b*. When, however, the arm 36 is at rest beyond this aligned position, the spring 44 is at a less than maximum tensioned (or lesser tensioned) state. In that the spring 44 will always tend to a less tensioned state, the sign S will always be urged to either the fully open (e.g., display) or the fully closed (e.g., storage) positions depending upon where the spring 44 resides (during its arc) relative to a line through the pivot axis $A_1$ or $A_2$.

As seen in FIGS. 1 and 2, the arm spring securing portion 42 is configured to engage or co-operate with the mount 16, 18 when the sign $S_1$ is in the open or display position. When in the closed position, the sign $S_1$ pivots to overlie the adjacent sign $S_2$ (as indicated by the arrows at 50 in FIG. 1), lying flat against the adjacent sign $S_2$.

A cap 51 is fitted on the top and bottom of the spine 14, to cover the mounts 16, 18 and the springs 44. The cap 51 is, however, configured and positioned to permit free rotation of the sign arms 36.

As set forth above, the spine 14 is mounted to the upright P by the floating insert 12. The insert 12, which is illustrated in FIGS. 2–6, is adapted to support the spine 14 (and thus the mount system 10) spaced from the face F of the upright P; that is, mounted off of the face F of the upright P. In such a configuration, the rear surface R of the sign S is forward of a plane $P_F$ defined by the faces F of the adjacent uprights P (see FIG. 1). As such proper positioning (i.e., lying flat) of the sign S will not be affected by the often present horizontal beam H. Rather, the beam H can be positioned behind the signs $S_1$, $S_2$ and the signs will lie flat, spaced from and along the front of the rack, forward of the uprights P.

The floating insert 12 includes a body 54 have central support portion 56 and pair of depending legs 58. The central support portion 56 and legs 58 define a squared C-shape as seen in FIG. 4 (or a squared U-shape depending upon the perspective, e.g., when viewed along the length of the upright P, see FIG. 2). The central portion 56 is an engagement surface for the spine 14 and the legs 58 are stand-offs to maintain the spine 14 spaced from the uprights P. An opening 60 is formed in the central portion 56.

A latch 62 is positioned in the insert body 54. The latch 62 has an elongated (upper) finger 64 and a (lower) hook element 66 that are spaced apart from and opposingly oriented to one another. A base portion 68 of the finger 64 includes a second (or upper) hook 70 that is commonly oriented with the lower hook 66. The second hook 70 is formed by a slot 72 in the finger base 68.

The latch 62 includes a threaded stub 74 that extends opposite of the finger 64 and hooks 66, 70. The latch 62 is disposed in the body 54 so that the stub 74 extends through the opening 60 in the body 54 and the finger 64 and lower hook 66 extend beyond the (upper and lower) ends of the body 54. The latch 62 floats within the body 54, but is secured within the body 54 by tabs 76 formed in the body 54 that are urged inward to "hold" the latch 62 at the stub 74. In this arrangement, the latch 62 is free to move toward and away from the central portion 56, but is maintained within the body 54 by the tabs 76.

Referring to FIG. 6, the floating insert 12 is configured to lock into the upright P. The upper finger 64 is inserted into an opening $O_1$ in the post face F until the lower or second hook 70 can be passed through a lower opening $O_2$. The insert 12 is then urged downwardly so that the hooks 66, 70 secure into the post face F.

The spine 14 is then positioned over the insert 12 with the stub 74 extending through an opening 22 in the spine face 20. A fastener 78 is threaded onto the stub 74. As the fastener 78 is tightened onto the stub 74, the latch 62 is pulled toward the spine 14 (tensioning the latch 62 against the spine 14), while the spine 14 is compressed against the insert body 54. This secures the spine 14 to the upright P.

An alternate, adjustable mount 116 is illustrated in FIGS. In this embodiment of the mount 116, an adjustable stop element 180 on the mount 116 engages the sign arm stop 148. Adjustability is provided by a threaded stud or fastener 182 that can threaded into and out of the mount 116 to vary the stop location of the arm 136 in the open position.

While a wide variety of materials can be used, in a present mounting system 10, the mount portions 16, 18, 116, 118 and arm 36, 136 are formed from steel or like high strength structural materials. It is contemplated that the sign $S_1$, $S_2$ structure is formed from a lightweight, flexible, high strength polymer material such as polyethylene or the like. The graphic G can, of course, be formed from paper or paperboard like materials or from polymers such as a low-density polyethylene material or the like.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the disclosed, exemplary embodiment.

What is claimed is:

1. A biased-based sign mounting system for mounting an associated sign to an associated structure, the structure including a vertical upright post having a face having a plurality of vertically extending, spaced apart openings, the mounting system comprising:

a spine adapted to mount to the vertical post, the spine having a face portion;

upper and lower mount portions mounted to the spine, at least one of the upper and lower mount portions having a first biasing element securing portion;

an upper arm and a lower arm mounted to the respective upper and lower mount portions, the upper and lower arms each having a pivot portion defining a pivot axis about the respective mount portion, the pivot axes being collinear, at least one of the upper and lower arms having a second biasing element securing portion;

a biasing element operably connecting the upper or lower arm to its respective mount portion at the respective first and second biasing element securing portions, wherein the arm is pivotal between first and second positions and is biased toward the first and second positions by the biasing element; and a floating insert for mounting the spine to the upright, the floating insert having a body portion for engaging the spine and the upright and for spacing the spine face portion from the upright face, the floating insert having a latch portion disposed in the body portion, the latch portion engageable with the upright to secure the floating insert to the upright, the latch portion including a latch portion fastener extending therefrom; the latch portion fastener structured, dimensioned and positioned in direct engagement with the spine to secure the spine to the floating insert, wherein when the floating insert is engaged with the upright and the latch portion fastener is engaged with the spine, the spine is secured to the upright with the face portion of the spine spaced from the face of the upright;

wherein the latch portion fastener is a threaded stub and wherein the floating insert body portion includes an opening for receiving the threaded stub.

2. The bias-assisted sign mounting system in accordance with claim 1 wherein the floating insert body includes a central support portion and depending legs extending from the central support portion, wherein the central portion is adapted to engage the spine and the legs are adapted to engage the face of the upright to space the face portion of the spine from the face of the upright.

3. The bias-assisted sign mounting system in accordance with claim 2 including tabs formed in the depending legs urged inwardly toward one another, the tabs configured to retain the latch portion within the body portion.

4. The bias-assisted sign mounting system in accordance with claim 1 wherein the latch portion has a finger and a first hook element spaced from one another, the finger and first hook element being opposingly oriented.

5. The bias-assisted sign mounting system in accordance with claim 4 wherein a base portion of the finger includes a second hook element that is commonly oriented with the first hook element, the second hook element being disposed between the finger and the first hook element.

6. The bias-assisted sign mounting system in accordance with claim 5 wherein the second hook element is formed as a slot in the base portion of the finger.

7. The bias-assisted sign mounting system in accordance with claim 1 wherein the threaded stub is adapted for insertion into an opening in the spine face portion.

8. A sign mount for mounting an associated sign to an associated structure, the structure including a vertical upright post having a face having a plurality of vertically extending, spaced apart openings, the sign mount including a spine having a face portion and having upper and lower pivoting mount portions, the sign mount comprising:

a floating insert for mounting the spine to the upright, the floating insert having a body portion for engaging the spine and the upright and for spacing the spine face portion from the upright face, the floating insert having a latch portion disposed in the body portion, the latch portion engageable with the upright to secure the floating insert to the upright, the latch portion including a latch portion fastener extending therefrom; the latch portion fastener structured, dimensioned and positioned for direct engagement with the spine to secure the spine to the floating insert, wherein when the floating insert is engaged with the upright and the latch portion fastener is engaged with the spine, the spine is secured to the upright with the face portion of the spine spaced from the face of the upright;

wherein the latch portion fastener is a threaded stub and wherein the floating insert body portion includes an opening for receiving the threaded stub.

9. The sign mount in accordance with claim 8 wherein the floating insert body includes a central support portion and depending legs extending from the central support portion, wherein the central support portion is adapted to engage the spine and the legs are adapted to engage the face of the upright to space the face portion of the spine from the face of the upright.

10. The sign mount in accordance with claim 9 including tabs formed in the depending legs urged inwardly toward one another, the tabs configured to retain the latch portion within the body portion.

11. The sign mount in accordance with claim 8 wherein the latch portion has a finger and a first hook element spaced from one another, the finger and first hook element being opposingly oriented.

12. The sign mount in accordance with claim 11 wherein a base portion of the finger includes a second hook element that is commonly oriented with the first hook element, the second hook element being disposed between the finger and the first hook element.

13. The sign mount accordance with claim 12 wherein the second hook element is formed as a slot in the base portion of the finger.

14. A sign mount for mounting an associated sign to an associated structure, the structure including a vertical upright post having a face having a plurality of vertically extending, spaced apart openings, the sign mount including a spine having a face portion and having upper and lower pivoting mount portions, the sign mount comprising:

a floating insert for mounting the spine to the upright, the floating insert having a body portion for engaging the spine and the upright and for spacing the spine face portion from the upright face, the floating insert having a latch portion disposed in the body portion, the latch portion engageable with the upright to secure the floating insert to the upright, the latch portion including a latch portion fastener extending therefrom; the latch portion fastener structured, dimensioned and positioned for engagement with the spine to secure the spine to the floating insert, wherein when the floating insert is engaged with the upright and the latch portion fastener is engaged with the spine, the spine is secured to the upright with the face portion of the spine spaced from the face of the upright;

wherein the latch portion fastener is a threaded stub and wherein the floating insert body portion includes an opening for receiving the threaded stub; and wherein the threaded stub is adapted for insertion into an opening in the spine face portion.

15. The sign mount in accordance with claim 14 wherein the floating insert body includes a central support portion and depending legs extending from the central support portion, wherein the central support portion is adapted to engage the spine and the legs are adapted to engage the face of the upright to space the face portion of the spine from the face of the upright.

16. The sign mount in accordance with claim 15 including tabs formed in the depending legs urged inwardly toward one another, the tabs configured to retain the latch portion within the body portion.

17. The sign mount in accordance with claim 14 wherein the latch portion has a finger and a first hook element spaced from one another, the finger and first hook element being opposingly oriented.

18. The sign mount in accordance with claim 17 wherein a base portion of the finger includes a second hook element that is commonly oriented with the first hook element, the second hook element being disposed between the finger and the first hook element.

19. The sign mount accordance with claim 18 wherein the second hook element is formed as a slot in the base portion of the finger.

* * * * *